United States Patent [19]

Spaulding

[11] 4,299,058

[45] Nov. 10, 1981

[54] DOOR CLOSURE

[76] Inventor: Floyd A. Spaulding, 2001 Country Club Rd., Mooresville, Ind. 46158

[21] Appl. No.: 83,217

[22] Filed: Oct. 9, 1979

[51] Int. Cl.[3] ..... E05F 1/10

[52] U.S. Cl. ..... 49/386; 16/72

[58] Field of Search ..... 49/386, 163; 16/72, 16/75, 76

[56] References Cited

U.S. PATENT DOCUMENTS 2,024,919 12/1935 Fredericks et al. ..... 16/72

2,041,914 5/1936 Ferrin ..... 16/72

4,094,099 6/1978 Birch ..... 49/163

*Primary Examiner*—Kenneth Downey

*Attorney, Agent, or Firm*—Marmaduke A. Hobbs

[57] ABSTRACT

A door closure for use on the outside of doors which open outwardly in which a spring is attached on one end to the door and is pivotally attached at the other end to the door frame. A clip is disposed over the spring and is secured to the door near the edge on the side to which the hinges are mounted and holds the spring near the surface of the door. As the door pivots outwardly about the axis of the hinge pins, the spring stretches and supplies retractive force when the door is released.

11 Claims, 5 Drawing Figures

DOOR CLOSURE

The entrance doors to travel trailers, campers and other recreational vehicles commonly have inner and outer doors, the outer door being a solid door, usually having a window therein, serving as a storm door to permit the vehicle to be closed against inclement weather, and the inner door being a screen door which will provide ventilation for the vehicle when the outer door is open. A securing means is often provided to hold the outer door and inner door together so that they may be opened and closed in unison; however, if it is desired to close only the inner screen door to provide ventilation for the trailer, the inner and outer doors are detached from one another and the outer door is secured open, thereby allowing the inner door to be opened and closed individually.

As with doors on houses and the like, the screen door may often be left open or slightly ajar, especially if children are present and frequently going in and out of the trailer, thus permitting flies, mosquitoes and other insects to enter the vehicle. Since travel trailers are frequently used in woods or fields for camping, the presence of insects around the vehicle is likely. For this reason it is desirable to have a screen door closure which will automatically close the screen door when the door is not held open.

In attempting to design a closure for the screen door on trailers and recreational vehicles, various difficulties have been encountered because of design requirements for operation of the door in a trailer structure. To permit the most complete use of the interior space of the trailer or recreational vehicle, both the inner and outer doors open outwardly; thus, the screen door must have an offset type hinge so that it may open over the outer door. Self closing hinges have proven unsatisfactory as screen door closure, in that hinges of the type used in these vehicles move through a wide arc to permit the door to open fully. Normally, both the inner and outer doors open to a position approximately parallel with the exterior wall of the trailer, thus moving through a range of approximately 180° between the closed and opened positions. Self closing hinges, when adjusted to permit the required range of motion to permit the doors to fully open, do not provide sufficient retractive force to close the doors completely. For appearance purposes as well as for the practicalities of locating attachment points on the interior trailer walls, conventional screen door closures attached on the inside of the inner door are impractical. Complex closure employing cable, pulleys and weights have been used; however, these are costly and unsightly, and installation is difficult. Prior to this time it was believed that closure for the screen door could not be located on the outside of the screen door in that the space between the inner and outer doors is normally only one half to one inch wide. This is due to the narrow door frames required for the thin wall construction of such vehicles to achieve lighter weight and increased usable interior space for the same external dimensions.

It is therefore one of the principal objects of the present invention to provide a door closure for use on travel trailers, recreational vehicles and the like which requires only a minimal amount of space for installation, thus fitting in the limited space between the inner and outer doors of conventional travel trailers, and which will automatically close the screen door completely when the door is released.

Another object of the present invention is to provide a door closure which will allow the door to open completely through a full range of movement approximately equal to 180°, and which will provide a smooth retraction of the door from its completely opened position to its fully closed position.

A further object of the present invention is to provide a door closure which is simple in design and can be installed quickly and easily by one of ordinary skills using conventional hand tools, and which can be produced and sold inexpensively for use on the outside of outwardly opening doors.

Additional objects and advantages of the present invention will become apparent from the following detailed description and the accompanying drawings wherein.

Figure 1:
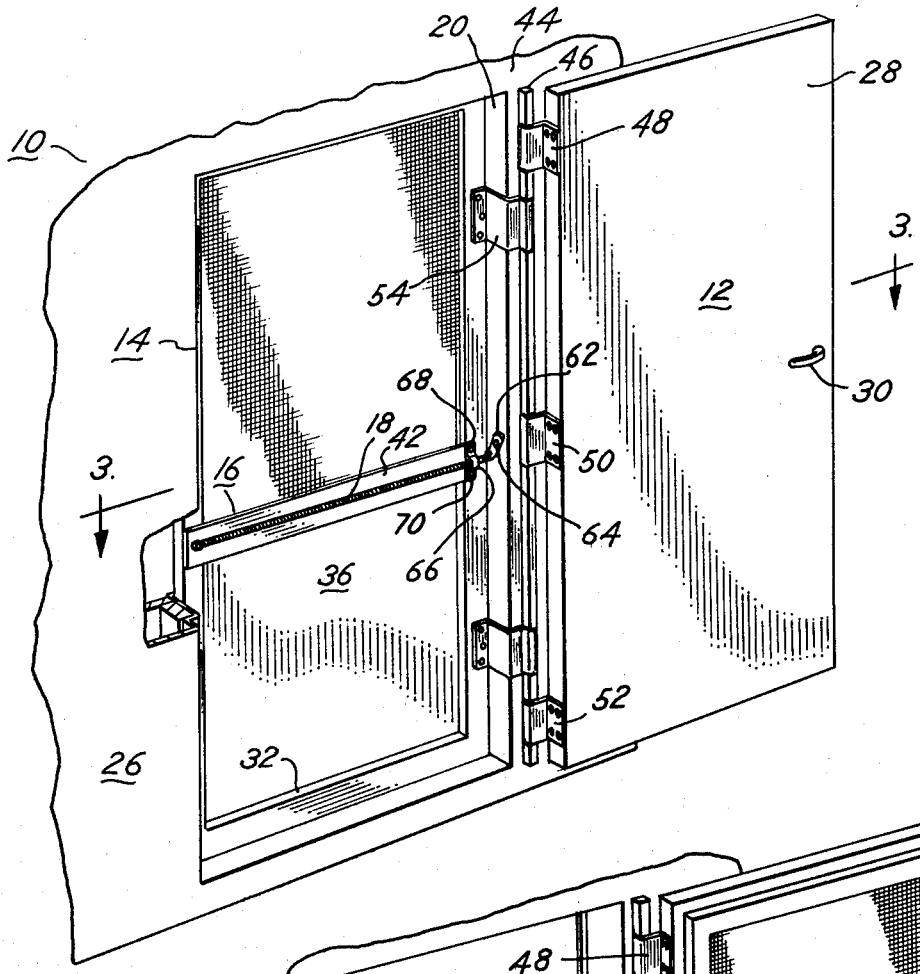
FIG. 1 is a perspective view, partially broken away, of the door structure of a travel trailer, with the inner door closed and the outer door open, and the inner door having a door closure embodying the present invention mounted thereon.
Figure 2:
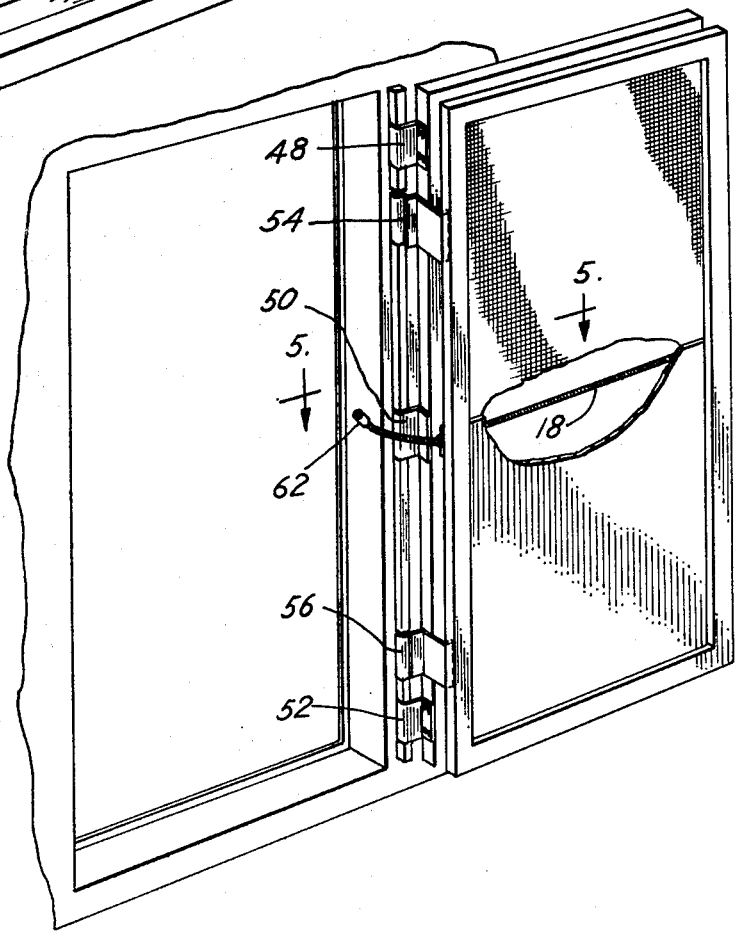
FIG. 2 is a perspective view, again partially broken away, of the same door structure showing both the inner and outer doors fully opened.

Referring more specifically to the drawings, and to FIG. 1 in particular, numeral 10 designates the door structure of a travel trailer having an exterior door assembly 12 and an interior door assembly 14. A door closure 16 embodying the present invention is mounted on the outside or leading face of interior door 14 and will close the door from the opened position shown in FIG. 2 to fully closed position. Door closure 16 consists of a spring 18 or other retractive device, such as a heavy elastic band, which is secured at one end to interior door assembly 14 and at the other of its ends to the door frame 20.

Exterior door assembly 12 and interior door assembly 14 are mounted in door frame 20 disposed in wall 22 of the trailer, which has an interior wall panel 24 and exterior wall panel 26. Normally wall 22 is only about two or three inches wide so as to provide a maximum amount of interior space for given exterior dimensions of the trailer. Thus, when exterior door assembly 12 and interior door assembly 14 are both closed, and hence are disposed within door frame 20, there is only a minimal amount of space between the doors, in many trailers less than one inch. Hence, it is essential for a door closure mounted on the exterior side of interior door 12 to be thin and compact in construction. The structure of the walls, doors and door frame are conventional, and door closure 16 of the present invention may be installed in most conventional constructions; hence, description of the doors and door frames will be given only to familiarize those skilled in the art with the views of the drawings.

Figure 3:
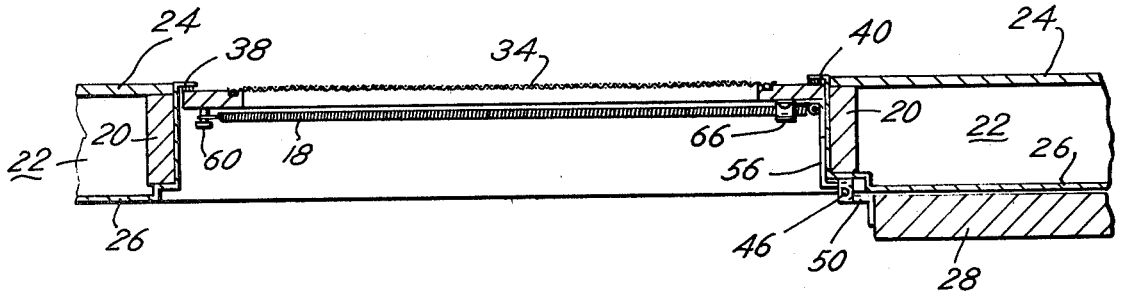
FIG. 3 is a horizontal cross sectional view of the door structure shown in FIG. 1 taken on line 3—3 of the latter figure.
Figure 4:
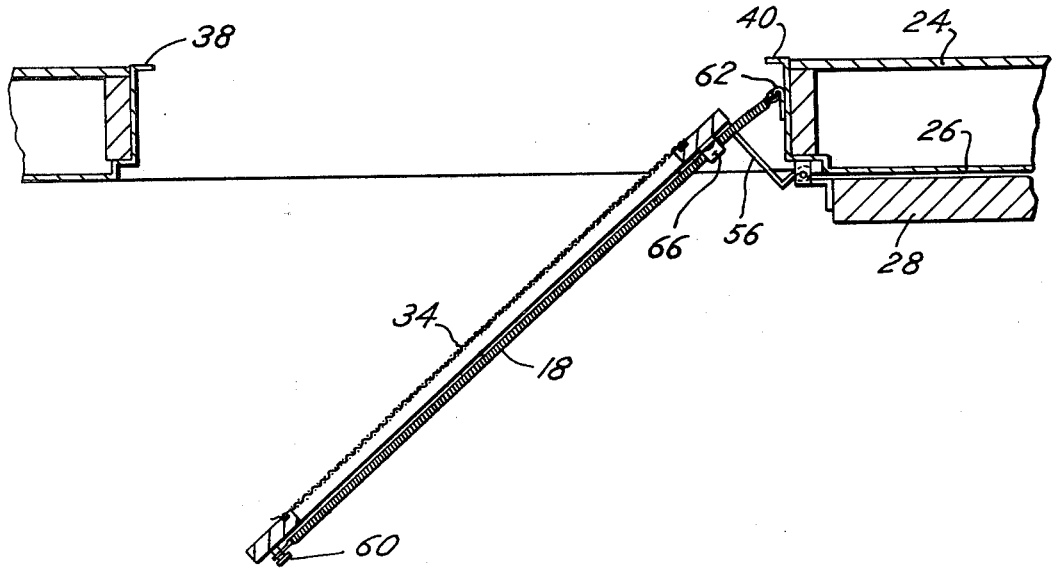
FIG. 4 is a horizontal cross sectional view similar to that shown in FIG. 3, but showing the screen door in a partially opened position.
Figure 5:
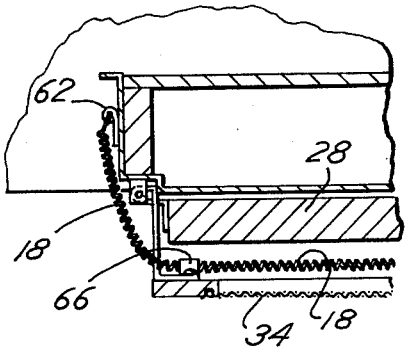
FIG. 5 is a fragmentary cross sectional view taken on line 5—5 of FIG. 2.

Exterior door assembly 12 consists of a door 28 which has a handle and latch assembly 30 mounted therein. Door 28 is normally a solid or insulated door and, when closed, effectively secures the trailer against inclement weather. Interior door assembly 14 normally is a screen type door having a frame 32 and upper and lower screen portions 34 and 36 mounted therein, and closes against door jamb elements 38 and 40 of door frame 20. A central median or bar 42 is normally disposed in interior door assembly 14 to provide increased rigidity to the door structure. When closed, both interior door 14 and exterior door 12 are disposed within door frame 20; however, when opened, exterior door 12 will lie flat against exterior wall panel 26 of wall 22 and interor door 14 will lie flat against exterior door 12. Movement of the doors in this manner is permitted by the hinge assembly 44 consisting of a mounting bar 46 on the exterior of the trailer and hinges 48, 50 and 52 on exterior door assembly 12, and hinges 54 and 56 on interior door assembly 14. The hinges are of the offset type, as is readily seen in the cross sectional views of FIGS. 3, 4 and 5. Hinges 48, 50 and 52 of exterior door 12 are generally L-shaped in cross section, and hinges 54 and 56 of interior door 14 are generally of a Z-shape. Hence, both doors will close to a position within door frame 20 and will open to lie against the exterior wall of the trailer.

As previously described, door closure 16 consists of spring 18 shown in the drawings as an elongated, coil tension spring, having one end attached to the interior door 14 and the other end attached to door frame 20. In the embodiment shown, a screw 60 is used to attach the spring 18 to frame 32 of interior door 14, and a clip 62 rotatably mounted on door frame 20 by a screw 64 secures the other end of the spring to frame 20. It should be understood that other attachment, such as bolts or clips, work equally as well for securing the spring to the door and door frame. A pivotal type attachment is preferred on the end of spring 18 which is secured to door frame 20. In the embodiment shown, clip 62 is mounted on frame 20 by screw 64 and can pivot about the screw to various positions, as can be seen clearly by comparing the positions of clip 62 in FIG. 1 and FIG. 2. The pivotal mounting is preferred when a metallic spring is used in view of the excessive bending which occurs near the attachment point when the door is fully opened. Metal fatigue may result if the attachment point is not pivotal, thereby causing the spring to break. If an elastic band is used in place of a spring, no significant fatigue will occur, and hence a pivotal mounting is not necessary. For proper operation of the door closure, a bracket device 66 is disposed over spring 18 and attached to the door near the point where the spring is attached to the door frame 20. Bracket 66 is secured to the door by screws 68 and 70 and holds spring 18 near door 14, but will allow the spring to slide longitudinally therethrough.

In the use and operation of a door closure embodying the present invention, spring 18 is attached at one end to door 14 by inserting the screw 60 through a loop in the end of the spring and into the door, and at the other end to the door frame 20 by clip 62. Bracket 66 is disposed over spring 18 near the pivotal clip attachment and is secured to the door. Spring 18 should be mounted in such a manner that there is no significant amount of slack in the entire length of the spring when the door is closed. As door assembly 14 is opened, the distance between the attachment point of the spring to the door frame 20, generally clip 62, and the attachment point of the spring to the door, generally screw 60, increases because of the offset nature of the hinges 54 and 56 and the location of their pivot point, which is mounting bar 46 on the outside of the trailer. Bracket 66 holds spring 18 close to door 14 between the bracket and the screw 60, and, as door 14 is opened, bracket 66 moves generally in an arc shaped path between its closed position and the position where it will ultimately be when door 14 is fully opened. Since most of the length of spring 18 is held against door 14, the distance between rotatable clip 62 and bracket 66 for any position of the door will be the length to which spring 18 will be stretched. Since no significant amount of slack exists in spring 18 in the closed door position, when the door is opened and the distance between bracket 66 and clip 62 increases, the spring will stretch and when the door is released, spring 18 will retract, pulling the door closed. By holding spring 18 near door 14, bracket 66 causes substantially the entire aforementioned distance increase to be imparted to the spring by preventing the spring from moving away from the door to find the shortest distance between screw 60 and clip 62. Thus, even a slight opening of the door will cause spring 18 to stretch. The location of bracket 66 near the hinge edge of the door prevents the spring from moving to the point where it will pull the door open rather than closed.

It is not essential that spring 18 extend completely across door 14, and the spring may be attached to door 14 at some intermediate point between bracket 66 and the free edge of the door. Attachment of the spring near the free edge of the door provides a more nearly constant force tending to close the door throughout the full range of operation from its fully opened position to its fully closed position. This minimizes slamming of the inner door as it is closed by the spring from wide open position. A closure of this embodiment permits the interior door 14 to be fully opened to the position where it will lie flat against fully opened door assembly 12. The maximum width of the closure is essentially that of bracket 66, and the closure will therefore fit in the very restricted space normally found between the interior and exterior doors of travel trailers. The closure is simple and may be installed by one with only a minimal amount of skill, using conventional hand tools.

Although one embodiment and several modifications of the new door closure have been described in detail herein, various other changes may be made without departing from the scope of the present invention.

I claim:

1. A closure for an outwardly swinging door having a frame and a hinge with its pivot point spaced outwardly from the door, said closure comprising a retraction means of flexible material for pulling the door closed from an open position, an attachment means for securing one end of said retraction means to the side of the door forming the leading face when the door is opened, a mounting means for securing the other end of said retraction means to the door frame between the door and the pivot point of the hinge at a point where substantially the entire length of said retraction means is generally parallel to the leading face of the door when the door is in the closed position, and a bracket disposed over said retraction means between said attachment means and said mounting means and permitting said retraction means to slide therethrough but retaining said retraction means near the door throughout the movement of the door between opened and closed positions.

2. A door closure as defined in claim 1 in which said retraction means is a spring.

3. A door closure as defined in claim 1 in which said retraction means is an elastic strip.

4. A door closure as defined in claim 2 in which said spring is of an elongated, coiled tension type.

5. A door closure as defined in claim 1 in which said mounting means is adapted to be pivotally attached to the door frame.

6. A door closure as defined in claim 2 in which said mounting means is adapted to be pivotally attached to the door frame.

7. A door closure for the inner door of a travel trailer, to be mounted between the outwardly opening inner and outer hinged doors of the trailer, comprising a spring, a means for attaching one end of said spring near the free end of the door, a mounting means for attaching the other end of said spring to the door frame at the hinge side of the door between said doors at a point where substantially the entire length of said spring is generally parallel to the leading face of the door when the door is in the closed position, and a bracket adapted to be disposed over said spring and secured to the door near the hinge edge thereof for holding said spring near the door and for restricting the movement of said spring away from the door as the door is moved toward an opened position.

8. A door closure as defined in claim 7 in which said mounting means is adapted to be rotatably mounted on said door frame.

9. A door closure as defined in claim 7 in which said spring is of an elongated, coiled tension type.

10. A door closure as defined in claim 7 in which said bracket is U-shaped and fits loosely over said coiled spring.

11. A door closure as defined in claim 7 in which said mounting means is adapted to be disposed between the inner door and the pivot point of the hinge therefor.

* * * * *